US009943123B2

(12) United States Patent
O'Leary

(10) Patent No.: US 9,943,123 B2
(45) Date of Patent: Apr. 17, 2018

(54) SWIMSUIT ASSEMBLY

(71) Applicant: Lauren O'Leary, Virginia Beach, VA (US)

(72) Inventor: Lauren O'Leary, Virginia Beach, VA (US)

( * ) Notice: Subject to any disclaimer, the term of this patent is extended or adjusted under 35 U.S.C. 154(b) by 505 days.

(21) Appl. No.: 14/816,307

(22) Filed: Aug. 3, 2015

(65) Prior Publication Data

US 2017/0035126 A1 Feb. 9, 2017

(51) Int. Cl.

| | |
|---|---|
| ***A41D 27/08*** | (2006.01) |
| ***A41D 7/00*** | (2006.01) |
| ***A44B 1/34*** | (2006.01) |
| *A44B 1/04* | (2006.01) |
| *A44C 3/00* | (2006.01) |

(52) U.S. Cl.

CPC ..... *A41D 27/08* (2013.01); *A41D 7/00* (2013.01); *A44B 1/34* (2013.01); *A44B 1/04* (2013.01); *A44C 3/001* (2013.01)

(58) Field of Classification Search

CPC .. A41D 27/08; A41D 7/00; A44B 1/34; A44B 1/04; A44C 3/001

See application file for complete search history.

(56) References Cited

U.S. PATENT DOCUMENTS

| | | | |
|---|---|---|---|
| 5,419,160 | A | 5/1995 | Fildan |
| 6,240,560 | B1 | 6/2001 | DeCaro |
| 7,396,273 | B2 | 7/2008 | Styles-Gaviria |
| 2012/0186109 | A1 | 7/2012 | Vanderbeek |

*Primary Examiner* — Richale Quinn

(74) *Attorney, Agent, or Firm* — Vincent G. LoTempio; Philip B. Abramowitz; Kloss, Stenger & LoTempio

(57) ABSTRACT

An ornamental swimsuit assembly interchanges ornamental members on a swimsuit through a snap fastening mechanism and extends colorful ribbons on to the swimsuit to enhance the visual appearance of the swimsuit. The ornamental members, such as rhinestones, are interchangeable and enhance the visual appearance of the swimsuit. A connector bracket enables straps on the swimsuit to be detachably attached to the body of the swimsuit. The assembly utilizes a snap fastening and thread mechanism to interchange the ornamental members to the swimsuit. The snap fastening mechanism involves a two-sided connection from the ribbon. The ribbon not only retains decorative caps and the ornamental members, but can also be extended in length through expander connectors to form bracelets, necklaces and other clothing types at a later date. In this manner, multiple ornamental combinations are possible between the swimsuit, the ribbon, decorative caps and the ornamental members.

20 Claims, 7 Drawing Sheets

SWIMSUIT ASSEMBLY

FIELD OF THE INVENTION

The present invention relates generally to an ornamental swimsuit assembly. More so, an ornamental swimsuit assembly enables interchangeability of at least one ornamental member on a swimsuit through a snap fastening mechanism, and also includes a ribbon that overlays at least one seam, and extends from the swimsuit to enhance the visual appearance of the swimsuit.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

It is known that a snap fastener is a pair of interlocking discs, made out of a metal or plastic, commonly used in place of buttons to fasten clothing and for similar purposes. A circular lip under one disc fits into a groove on the top of the other, holding them fast until a certain amount of force is applied. The snap fastener is configured to close with minimal force, and provide a click, or a sharp, cracking sound to indicate that fastening is secure. It is known in the art that the two types of snaps include the post-style snap, and the prong-style snap.

Typically, a swimsuit is an item of clothing designed to be worn by people engaging in a water-based activity or water sports, such as swimming, water polo, diving, surfing, water skiing, or during activities in the sun, such as sun bathing. Different types of swimsuits are worn by men, women, and children. Generally, people wear swimsuits having bright colors and decorative features.

It is known that a designer attempts to enhance the decorative aspects of swimsuits to appeal to the consuming public, especially women. However, there is only so much a designer can do to change and update swimsuit designs. Usually the changes are minimal like changing fabrics, adding embellishments to the suits like buttons, fringe or lace but the embellishments are permanently attached to the suits. Generally, swimsuit designers are constantly changing their lines to draw buyers to them. However few of the designs they come up with are unique or totally original or designed to fit the average woman's body type. Decorative jewelry like accessories can be easily interchanged to dress up swimsuits to appeal to the widest market.

Generally, swimsuits have a proclivity to wear out. The swimsuits often do not fit properly or become outdated. Thus, women buy new ones. Other problems occur when women gain or lose weight and have to replace their swimsuits because their size changes. Yet another challenge is when a woman's top size and the bottom size don't match but the designer only offers the swimsuit in the same size instead of mixing and matching options.

It is known that traveling and vacationing with swimsuits present yet another challenge. Most women enjoy having several swimsuits with them to interchange while on vacation especially if they are traveling with a group of friends. They don't want to be seen in the same swimsuit the entire trip. Having to buy multiple swimsuits for these occasions is expensive and dreaded for all the reasons outlined above.

It is known that many women, especially as they age, don't like to shop for new swimsuits because they don't like their figures and get overwhelmed at the thought of having to try them on. Being able to extend the life of a favorite swim suit is appealing or to be able to re-buy the same basic swimsuit that has fit well from the past in mix and match sizes and to be able to dress the swimsuit up or down is appealing. Though the top size may be different than the bottom. The present invention is the "little black dress" of swimsuits.

Other proposals have involved integrating decorative members into a garment. The problem is that these devices use fastening mechanisms that are permanent, or are problematic to remove from the garment and are not generally waterproof for use with water activity garments. Thus, an unaddressed need exists in the industry to address the aforementioned deficiencies and inadequacies. Even though the above cited methods for a garment with decorative members integrated therein meets some of the needs of the market, an ornamental swimsuit assembly that interchanges ornamental members on to a swimsuit through a snap fastening mechanism, is still desired.

Swimsuits with decorative features have been utilized in the past; yet none with the interchangeability of ornamental members through snap fastening mechanism means of the present invention. See U.S. Pat. Nos. 5,419,160; 6,240,560; 7,396,273, and 20120186109.

SUMMARY OF THE INVENTION

The present invention is directed to an ornamental swimsuit assembly that enables interchangeability of at least one ornamental member on a swimsuit through a snap fastening mechanism. The assembly also includes a ribbon that overlays at least one seam, and extends from the swimsuit to enhance the visual appearance of the swimsuit. The assembly utilizes a snap fastening mechanism to easily interchange ornamental features on the swimsuit. The ornamental members are easily attached and detached from a ribbon, which is itself detachably joined with the swimsuit, through both snap fastening mechanisms and threaded engagements. In this manner, the ornamental members may be easily added and removed from the ribbon, and the ribbon may also be easily added and removed from the swimsuit. In another embodiment, the ribbons are extended with connectors to form bracelets and necklaces. In this manner, myriad ornamental combinations are possible with the swimsuit.

In some embodiments, the assembly is used with a swimsuit. The swimsuit is defined by a body portion, at least one strap, and at least one seam. The strap is configured to detachably attach to the body portion. The swimsuit may include a bikini, two-piece, or one-piece swimming/bathing garment known in the art. In some embodiments, the assembly comprises a ribbon that overlays the swimsuit at the body portion or the at least one seam. The ribbon is defined by a ribbon first end, a ribbon second end, a mounting surface, a cap, and an ornamental surface. In some embodiments, the ribbon may be fabricated from a stretchable, waterproof material. The ribbon can be attached to various sections of the swimsuit. The ribbon may be extended across at least one seam or a body portion of the swimsuit. The ribbon may extend across the front or the rear of the swimsuit. The ribbon may be extended by attaching multiple ribbons together through a series of connectors, as discussed below. The ribbon is generally interchangeable and carries a variety of interchangeable decorative caps and ornamental members.

In some embodiments, the assembly may include a cap. The cap is defined by a threaded protrusion that extends from a flat disc. The cap forms a decorative, colorful disc shape that is visible from the ornamental surface of the ribbon. The ribbon may be studded with a plurality of caps at spaced-apart intervals. In one embodiment, all the caps have threaded protrusions so any cap can add the ornamental members.

The cap comprises a mechanical snap fastening mechanism having a closure unit and an attaching unit. When performing its primary function of fastening to an ornamental assembly, the cap closes on the mounting member with a click, or a sharp, cracking sound. A threaded protrusion extends from the cap and passes through the ribbon. The threaded protrusion is configured to be urged in a first direction for helping to fasten to the ornamental member, and a second direction for unfastening the ornamental member. Both the snap fastening mechanism and the threaded rotation work together to detachably join the ornamental member to the cap. The cap serves multiple purposes. The cap has a decorative outer surface that enhances the ribbon. The cap detachably joins with an ornamental member through frictional engagement from the snap mechanisms, and rotatable engagement from the threaded protrusion.

The cap also detachably joins the ribbon to the swimsuit through the use of a mounting member. The mounting member encloses the threaded protrusion. The mounting member has a mount end for receiving the threaded protrusion of the cap, and an oppositely disposed reception end for interlocking with additional fastening mechanisms on the swimsuit discussed below.

An ornamental member forms the outermost, visible portion of the assembly. The ornamental member may include the actual diamond, rhinestone, bead, lace, button, gem, metal, charm, shell, fringe etc. The ornamental member may be selectively attached to the ribbon, and is generally interchangeable. The ornamental member comprises an outer portion and a cavity. The outer portion forms the most visible, prominent ornament in the assembly. The ornamental member rotatably fastens and detaches to the ribbon to enable interchangeability with a variety of other ornamental members. The cavity forms a mechanical snap closure, and in some embodiments may have a threaded inner surface with a groove, or a smooth tapered surface. Thus, the cavity fastens with both a snap frictional engagement and/or a rotational engagement.

For fastening, the ornamental member is configured to couple to the cap, such that the outer portion of the ornamental member and its cavity fits and slides over the cap to twist and secure just under the snap cap and on to the threaded protrusion. This may require twisting and pressing manipulations of the ornamental member onto the cap to overcome the barrier and snap into place. After the ornamental member passes over the cap, the cavity of the ornamental member rotatably engages the threaded protrusion of the cap in a first direction. This rotation further fastens the components together.

The ornamental member has a cavity and is of a diameter slightly larger than the snap cap so that it can slide over the snap to twist and secure onto the ribbon. The cavity can also be in many geometrical shapes as long as it matches the shape of the cap of the snap. For example different sizes referred to as 5 karat etc., or square, circular, rectangular etc. However, the shape in one embodiment is all the same.

For detachment, the ornamental member also has a thread cavity that is rotated in a second direction and a small pulling force is applied to disengage the ornamental member from the cap. In this manner, any number and type of ornamental members may be used on the ribbon. It is significant to note that not every cap must have an ornamental member. The cap is generally decorative and colorful by itself and may be manufactured in any geometric shape or material as long as the center cavity of the ornamental member matches the shape of the snap cap and is slightly larger to allow for it to slide over the cap and twist onto the threaded protrusion and secure. The ornamental member may be used solely as an accent.

In some embodiments, the assembly may further include a connector that joins adjacent ends of the ribbon to extend their length. In this manner, multiple ribbons may be connected at their ends, and thus extended in length, to convert into bracelets or necklaces. In some embodiments, two connecters may join. The connector is defined by a connector first end and a connector second end. The connector first end may include at least two of the cap snaps that fasten to the cap. This not only enhances the decorative aspect of the ribbon, but also attaches the connector thereto. The connector second end may join with an adjacent connector. This extends the length of the ribbon. Thus the connector performs the dual function of extending the length of the ribbons and providing decorative caps at the junction with the ribbon.

In some embodiments, the assembly further includes a connector bracket. The bracket is configured to detachably attach the at least one strap to the body portion of the swimsuit. The connector bracket is defined by a generally U-shape bracket and a connector.

In some embodiments, an expander may be used to join two ribbon connectors. The expander comprises a pair of free ends, with each free end configured to join with a respective second end from the ribbon connector. In some embodiments, the expander may have a resilient composition for enabling stretching. The expander further enables the ribbons to be extended to form bracelets and necklaces.

It is one objective of the present invention to provide a swimsuit with detachable and interchangeable ornamental members.

Another objective is to provide ornamental members that are waterproof and generally easy to replace.

Another objective is to provide a fastening mechanism between the ornamental member and the mounting member that requires little force or complicated manipulations to attach and detach.

Yet another objective is to provide a connector bracket on to the ribbon that allows for interchangeable straps and ties to be hooked onto the U-shape bracket by a hook.

Yet another objective is to provide an inexpensive and easy to use ornamental swimsuit assembly.

Yet another objective is to provide ribbons with caps and ornamental members available for purchase separately.

Yet another objective is to be able to dress up or down a swimsuit

Yet another objective is to extend the life of the swimsuit by interchanging ribbons and ornamental members to dramatically change the look of the swimsuit.

Yet another objective is to save money since it is not necessary to buy an entirely new swimsuit because only the ribbons and ornamental members need to be purchased to dramatically change the look of a swimsuit.

Yet another objective is that when traveling, the ribbons and ornamental members are small and don't take up room in luggage.

Yet another objective is to provide a carrying case that will fit the ribbons, ornamental members, and various connectors, since these components are similar to jewelry.

Yet another objective is to provide ribbons that stretch to fit up to three different size swimsuits with the same ribbon; such as a bikini size 4, 6 and 8 to accommodate weight gain or loss or if swapping and sharing ribbons.

Yet another objective is to vary spacing between mounting members on the swimsuit seams to attach cap coupling ribbons that stretch to accommodate the spacing there between.

Yet another objective is to appeal to the collector sales model by collecting the ribbons and ornamental members.

Yet another objective is for the swimsuit to meet both universal and individual wardrobe essential criteria. The little black dress of swimsuits.

Yet another objective is to provide versatile, monochromatic, neutral in color or black swimsuit fabrics with mounting members because the color is flattering and a great backdrop for colorful ribbons and especially black is considered a wardrobe essential.

Yet another objective is to provide ribbons that are versatile and can be joined together and lengthened with a connector to convert the ribbons into a bracelet or necklace.

Yet another objective is to allow the ribbons to be removed for cleaning the swimsuits or when it is desired for it to be removed to protect the ribbon from the elements or chemicals in a pool.

Yet another objective is to allow the ribbons to be completely waterproof so it is not necessary to remove in water.

Yet another objective is to allow the ribbon to be removed when attached with valuable gems or when the ornamental member is not waterproof.

Yet another objective is to allow the assembly to be worn under a V-neck T-shirt or open top, so as to resemble a decorative camisole.

Yet another objective is for the customization and personalization of a swimsuit to an individuals taste and budget.

Yet another objective is for the ribbons and ornamental members to be interchangeable to other types of clothing types such as hats or work out clothing at a later date that will use the compatible caps, mounting members, ribbons, ornamental members and connectors.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The present invention and the manner in which it may be practiced is further illustrated with reference to the accompanying drawings wherein:

FIG. 4A is an exemplary cap positioned above an exemplary mounting member, and FIG. 4B is the cap coupling to the mounting member, in accordance with an embodiment of the present invention;

FIG. 5A is an outer portion of a single decorative ornamental accent panel with a large decorative cap and an ornamental member slipped over a 10 Karat cap by way of the threaded cavity, and twisted on to the threaded protrusion; FIG. 5B is an ornamental accent panel with an outer portion with five ornamental caps; FIG. 5C is an accent panel with a 10 Karat cap without an ornamental member added, wherein the accent panels enhance a swimsuit by providing more options for interchanging decorative caps and ornamental members;

FIG. 6 may be sewn into the swimsuit from at its perimeter, wherein a series of perimeter holes on the panel mounting surface may help to provide guidance and facilitate the sewing process; wherein the accent panel is sewn on to the swimsuit in strategic locations such as between the bikini top breast sections to further decorate and enhance the swimsuit by providing additional options for interchanging decorative accents panels with caps and ornamental members, leather buttons, and the like, in accordance with an embodiment of the present invention;

Like reference numerals refer to like parts throughout the various views of the drawings.152

DETAILED DESCRIPTION OF THE INVENTION

Figure 1:
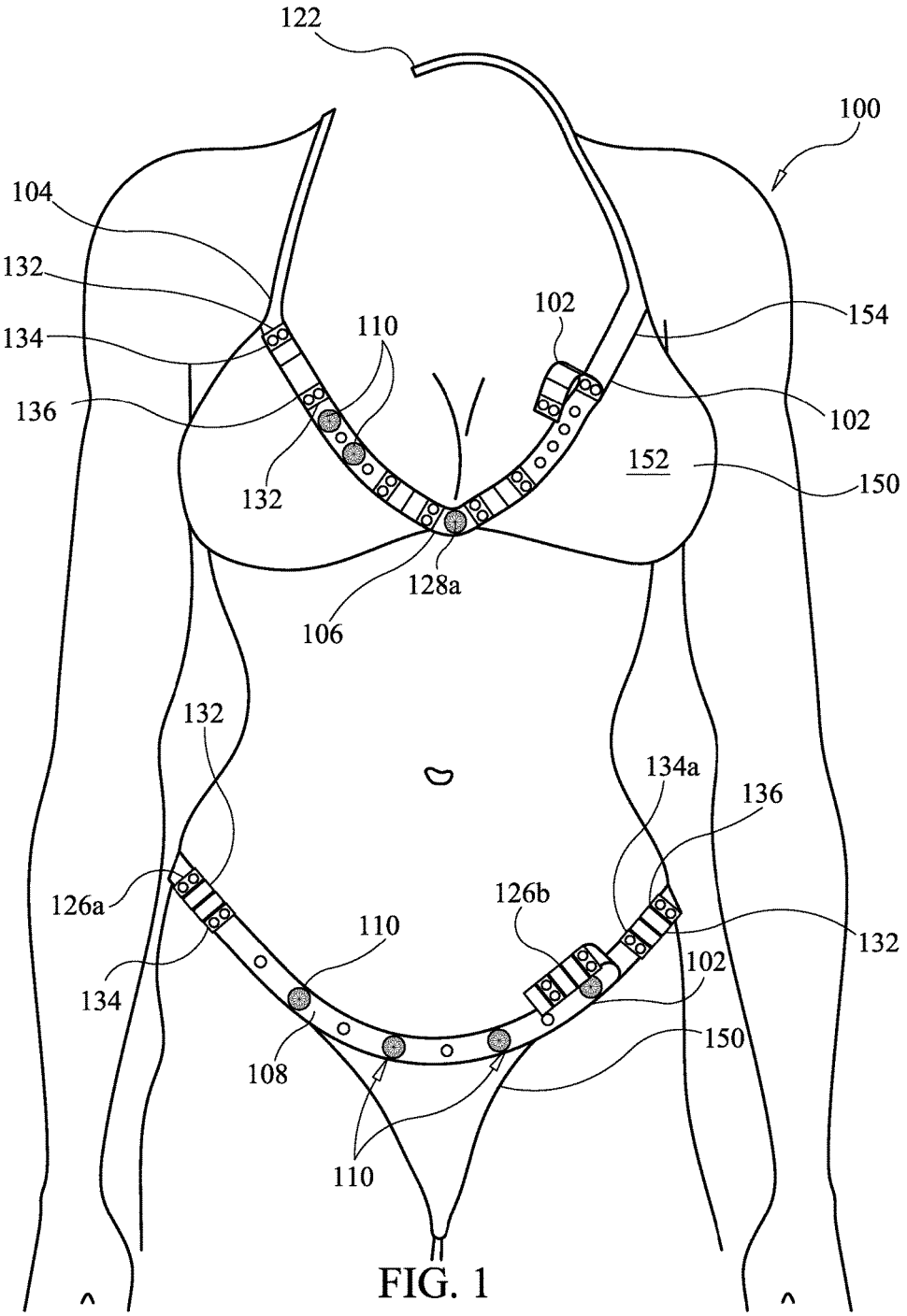
FIG. 1 is a frontal view of an exemplary ornamental swimsuit assembly integrated into a two-piece swimsuit with three ribbons, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

In one embodiment of the present invention, presented in FIGS. 1-8, an ornamental swimsuit assembly 100, hereafter "assembly", enables interchangeability of at least one ornamental member 120 on a swimsuit 150 through a snap fastening mechanism. The assembly 100 also includes a ribbon 102 that overlays at least one seam 154, and extends from the swimsuit 150 to enhance the visual appearance of the swimsuit 150.

Figure 2:
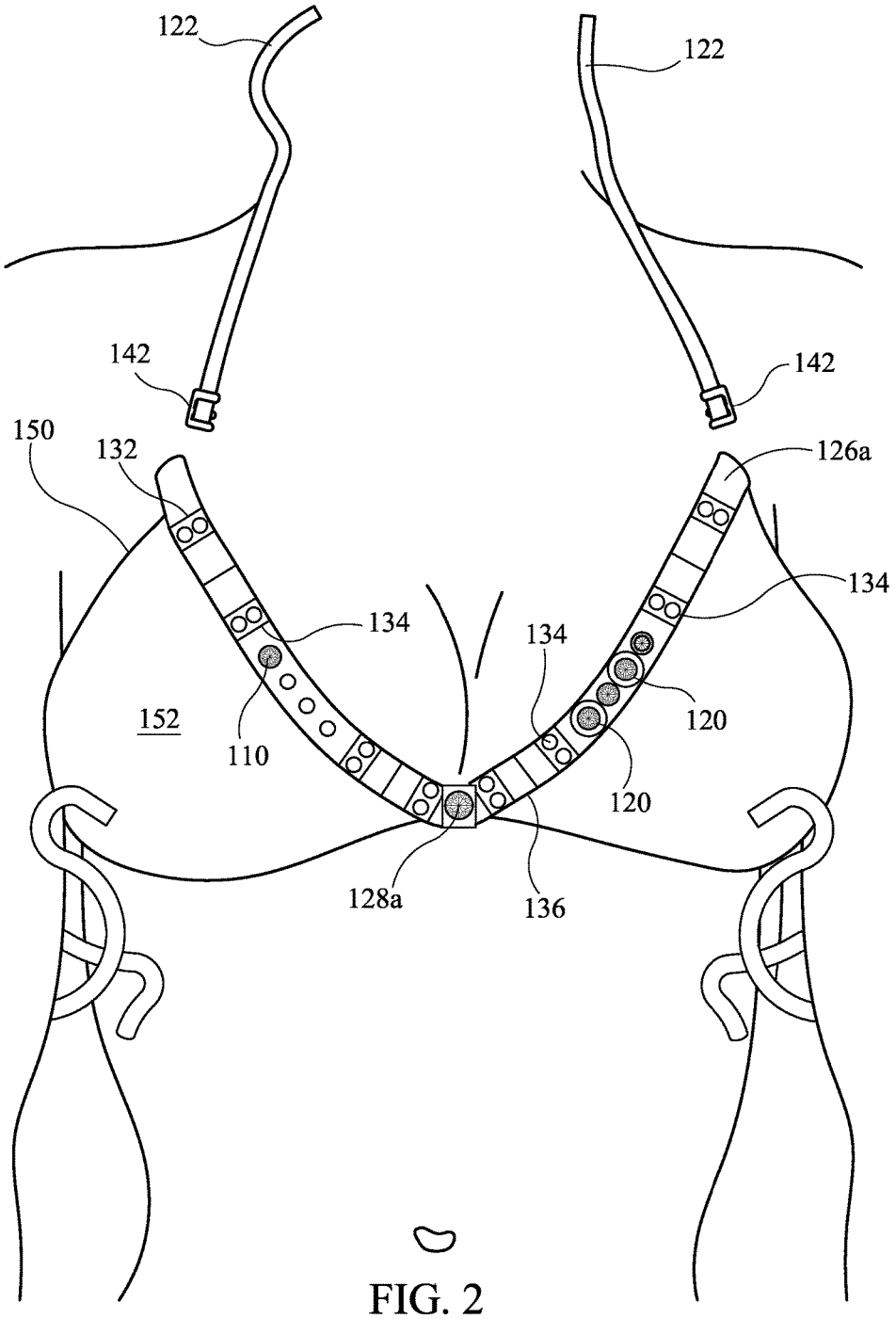
FIG. 2 is a close-up view of a breast region of the ornamental swimsuit assembly, in accordance with an embodiment of the present invention.
Figure 3:
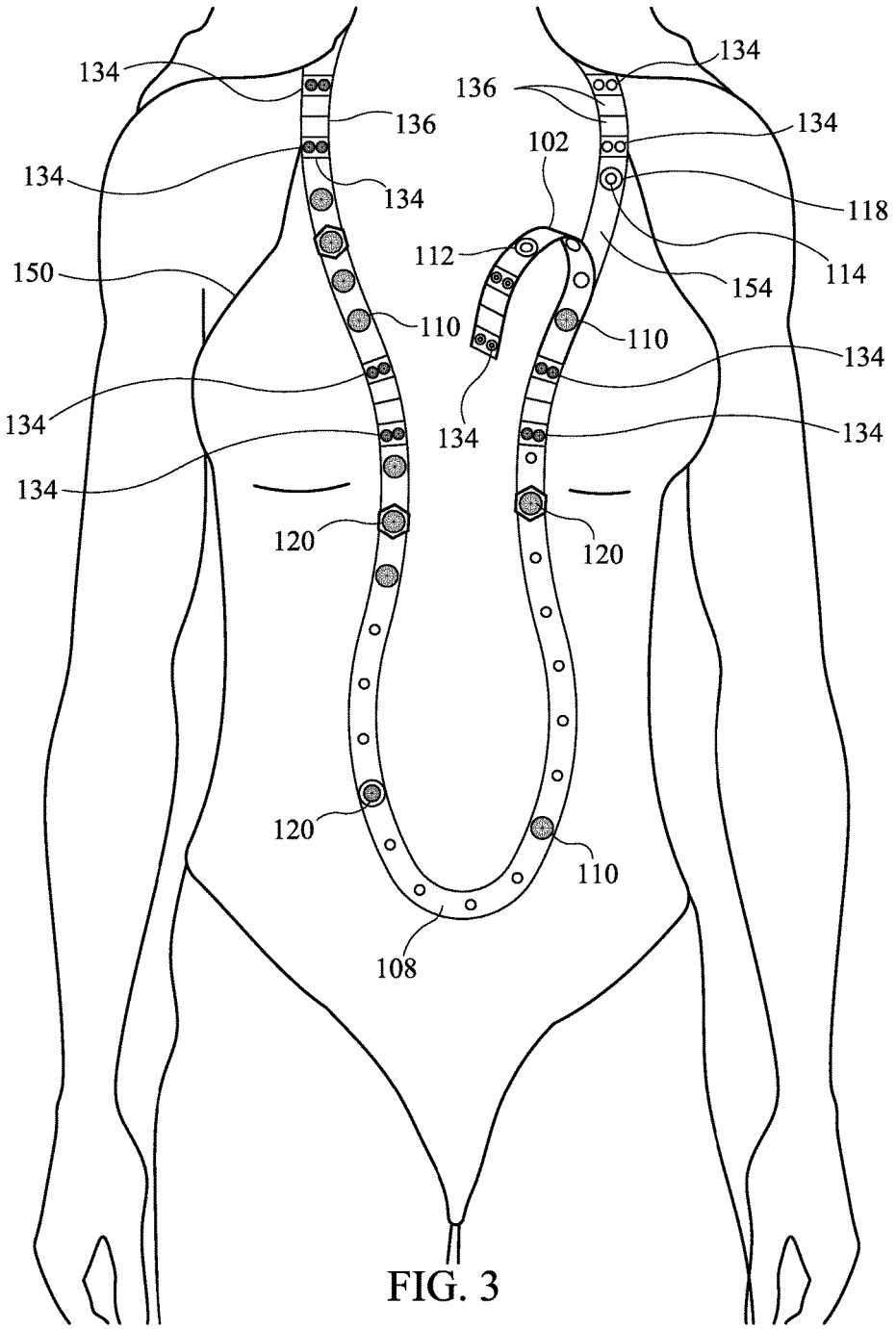
FIG. 3 is a frontal view of an exemplary ornamental swimsuit assembly integrated into a one-piece swimsuit, in accordance with an embodiment of the present invention.

As referenced in FIGS. 1-3, the assembly 100 includes a swimsuit 150. The swimsuit 150 is defined by a body portion 152, at least one strap 122, and at least one seam 154. The strap 122 is configured to detachably attach to the body portion 152, so as to be removable. The swimsuit 150 may include a bikini, two-piece, or one-piece swimming/bathing garment known in the art. In some embodiments, the assembly 100 comprises a ribbon 102 that overlays the swimsuit 150 at the at least one seam 154. An ornamental member 120, manufactured in varying materials such as diamonds, rhinestones, and trinkets, are interchangeable on the ribbon 102 and serve to enhance the visual appearance of the swimsuit 150.

The ornamental members 120 are easily attached and detached from the ribbon 102, which is itself detachably joined with the swimsuit 150, through both snap fastening mechanisms and threaded engagements. The ribbon 102 may extend across the front or the rear of the swimsuit 150. In this manner, the ornamental members 120 may be easily added and removed from generally any section of the swimsuit 150, and the ribbon 102 may also be easily added and removed from the swimsuit 150. This creates multiple decorative combinations for the swimsuit 150.

In some embodiments, the assembly 100 further includes a connector bracket 126*a-c*. The connector bracket 126*a* is configured to detachably attach the at least one strap 122 with hook 142 to the body portion 152 of the swimsuit 150. The connector bracket 126*a-c* is defined by a generally U-shape bracket 126*a*, a connector with two ornamental caps 126*b* and a connector panel 126*a-c*. The connector bracket 126*a* connects to another connector 132 to secure the ribbon on to the swimsuit and provides two functions; a visible ornamental connector that snaps with threaded protrusion 112 onto a mount end 118 on the swimsuit on to connector 134.

The snap fastening mechanism involves a two-sided connection from both surface sides of the ribbon 102. For example, a mounting surface 130 of the ribbon 102 engages the swimsuit 150. An ornamental surface 108 of the ribbon 102 detachably joins with the ornamental member 120. The ribbon 102 not only overlays the swimsuit 150 and retains the decorative caps 110 and ornamental members 120, but may also be removed from the swimsuit 150 and in a separate option extended in length through various connectors to form bracelets and necklaces. In this manner, myriad ornamental combinations are possible between the ribbon 102, the decorative caps 110, ornamental members 120, and the swimsuit 150.

Figure 4A:
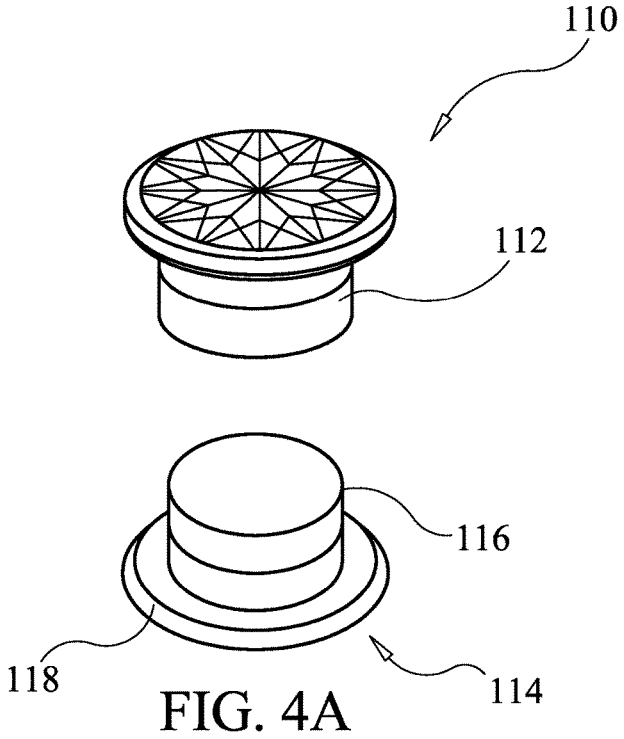
FIGS. 4A and 4B are perspective views of exemplary fastening mechanisms, where
Figure 4B:
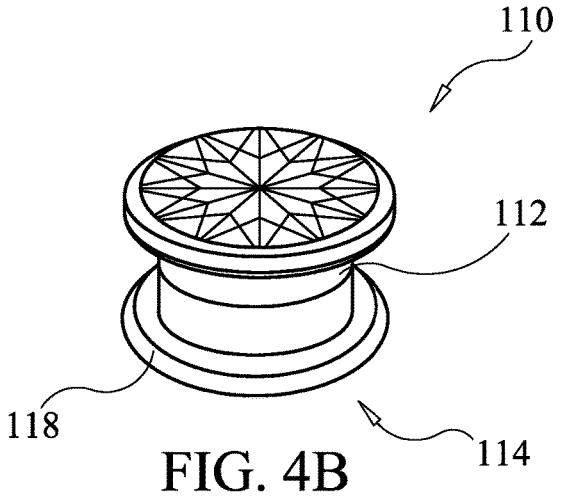

The threaded protrusion 112 with decorative cap 110 is configured to close with minimal force, and provide a click, or a sharp, cracking sound to indicate that fastening is secure to the mounting member 114. This type of mechanism may be especially effective for enabling interchangeability of ornamental members 120 and ribbons 102 onto the swimsuit 150. It is known in the art that the two types of snaps include the post-style snap, and the prong-style snap the exemplary design of snaps used in this patent are of a threaded style snap consisting of a cap 110, thread protrusion 112, reception end 116, mounting member 114 and mount end 118 as illustrated in FIGS. 4A and 4B.

In one possible embodiment, the snap fastener used by the assembly 100 is a post style snap. However, in other embodiments, a prong style snap or any other snap-styled fastening mechanism may be used. The present invention may utilize any number of snap fastening mechanisms, including, without limitation, a lip/groove interconnection, interlocking discs, rivets, and pressure fittings. Though, for the present invention, the threaded-style snap or post style snap may be more efficient for a swimsuit 150 application to ensure the snaps are more industrial and do not pull or rip from the swimsuit 150 during active wear.

As illustrated in FIG. 1, the assembly 100 comprises a swimsuit 150. The swimsuit 150 is defined by a swimsuit 150 and at least one seam 154. The swimsuit 150 may include, without limitation, a bikini, a two-piece swimsuit, a one-piece swimsuit, a bathing suit, a thong, a wet suit, and a dry suit. Those skilled in the art will recognize that adorning a swimsuit 150 is a popular affair, especially during water activities. One objective of the assembly 100 is to extend the life of the swimsuit 150 by providing interchangeable decorative ornaments thereon. Thus, it may not be necessary to change swimsuits 150 to create a new appearance. This can be especially useful for female swimsuits 150. The swimsuit 150 may be available in mix and match sizes.

Turning now to FIG. 2, the assembly 100 comprises a ribbon 102 that overlays the swimsuit 150 along the at least one seam 154 of the swimsuit 150. The ribbon 102 is generally elongated and defined by a ribbon first end 104, a ribbon second end 106, a mounting surface 130, and an ornamental surface 108. The ribbon 102 is detachable from the swimsuit 150 through the snap fastening mechanism. The ribbon 102 also interchangeably retains an ornamental member 120 along the length of its ornamental surface 108 through both a snap fastening mechanism and a threaded engagement. The ribbon 102 may detachably join with the at least one seam 154 of the swimsuit 150, such as along the waist, thigh, back, hip, or breast area.

The length of the ribbon 102 may be extended by stretching, or through the attachment of multiple ribbons 102 together through a connector 132 or expander 138, as discussed below. Depending on the style of the swimsuit 150, the ribbon 102 can be configured to take myriad shapes. For example, in FIG. 3, the ribbon 102 follows a generally V-shape, while FIG. 1 illustrates the ribbon 102 forming a perimeter to the breast region and the lower waist region of the swimsuit 150. The ribbon 102 may also take any variety of colors, textures, and material fabrications.

In any case, the ribbon 102 is generally interchangeable and carries a variety of interchangeable decorative snaps and caps. In some embodiments, the connector bracket system 126*a-c* on the ribbon 102 enables interchangeable additional straps with hooks 142 to be added on to the U-shaped bracket that extends just past the end seam of the swimsuit at the bottom right or left, swimsuit top right or left, or neck right or left. Straps tie to hold the swimsuit in place. The connector 134 adjusts the length of the ribbon 102, but can also have an ornamental member 120 attached to the two caps. Furthermore, the ribbon 102 can have stretchable expanders FIG. 8 that enable the ribbons 102 to expand longitudinally.

The capacity to expand enables the ribbon 102 to be converted into a bracelet or necklace. The expansion of the ribbon 102 can also compensate for weight gain by a person. In some embodiments, the ribbon 102 may be fabricated from a stretchable, waterproof material. The ribbon 102 may stretch up to three sizes. The ribbon 102 may have a variety of colors, patterns, and shapes. Suitable materials for the ribbon 102 may include, without limitation, spandex, polyester, cotton, rubber, and a nonwoven material.

As referenced in FIG. 4A, the assembly 100 may include a cap 110 having a threaded protrusion 112 that extends from a generally flat disc. The cap 110 may form a decorative, colorful disc shape that is visible from the ornamental surface 108 of the ribbon 102. The cap 110 may have various shapes and sizes. In one embodiment, the cap 110 has a monotone color to contrast with the bright color of the ribbon 102. In another embodiment, the cap 110 has various sizes and size labels 128*a*, 128*b*, 128*c*, and 128*d* including, without limitation, 5 karat, 7 karat, 8 karat, and 10 karat. FIG. 5C might represent a 10 karat snap cap.

The ribbon 102 may be studded with a plurality of caps 110 at spaced-apart intervals. Though in some embodiments, a single cap 110 may be used as an accent panel 128*a*, 128*b* and 128*c*. The top of the accent panel 128*a* snaps on to the bottom of the panel mounting surface 130. The panel mounting surface 130 may be sewn into the swimsuit 150 from at its perimeter. A series of perimeter holes 128*d* on the panel mounting surface 130 may help provide guidance and facilitate the sewing process. The accent panel provides a way to interchange varying decorative accent panels with different size caps 110 with ornamental members 120 as in FIG. 5A. Or a single snap cap design representing a 10 Karat size in FIG. 5C or multiple snap caps FIG. 5B. The accent panels may be sewn onto the swimsuit 150 between the two breast sections of the swimsuit on either a one piece or bikini as well as other locations on the swimsuit 150 if desired.

The cap 110 comprises a mechanical snap fastening mechanism having a closure unit and an attaching unit. When performing its primary function of fastening to an ornamental assembly 100, the cap 110 closes on the reception end 116 with a click, or a sharp, cracking sound. A threaded protrusion 112 extends from the cap 110 and passes through the ribbon 102. The threaded protrusion 112 is configured to snap and be urged in a first direction for helping to fasten to the mounting member 114, and a second direction for unfastening the ornamental member 120. Both the snap fastening mechanism and the threaded rotation work together to detachably join the cap 110. For example, the ornamental member 120 twists onto the cap 110.

The cap 110 serves multiple purposes. In one use, the cap 110 has a decorative outer surface that enhances the ornamental appearance of the ribbon 102, and the swimsuit 150 in general. Secondly, the cap 110 detachably joins with an ornamental member 120 through frictional engagement from the snap mechanisms, and rotatable engagement from the threaded protrusion 112.

Finally, as illustrated in FIG. 4B, the cap 110 detachably joins the ribbon 102 to the swimsuit 150 through the use of a mounting member 114. The mounting member 114 encloses the threaded protrusion 112. The mounting member 114 has a mount end 118 for receiving the threaded protrusion 112, and an oppositely disposed reception end 116 for interlocking with additional fastening mechanisms on the swimsuit 150 discussed below.

Figure 5A:
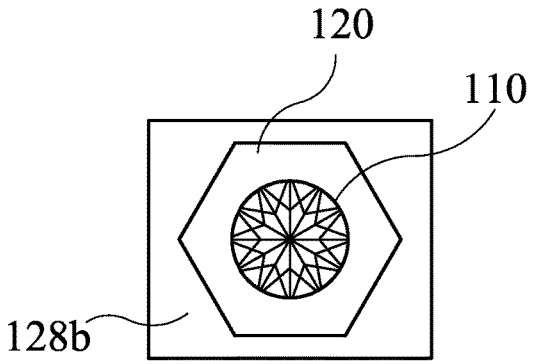
FIGS. 5A, 5B and 5C are top views of exemplary ornamental accent panel, where
Figure 5B:
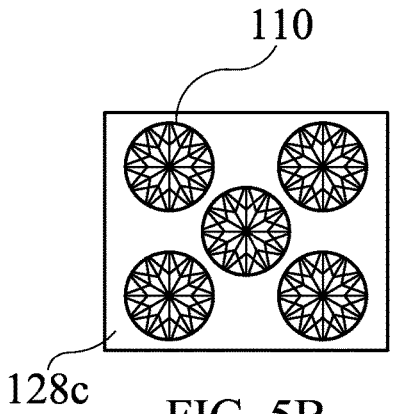
Figure 5C:
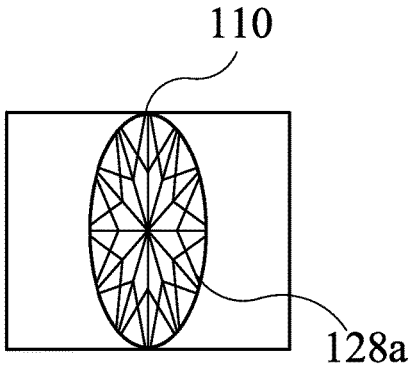

As shown in FIGS. 5A, 5B and 5C, the cap 110 or ornamental member 120 may include, without limitation a diamond, a bead, a rhinestone, a gem, a bow, a bell, lace, a band, a strap, a bauble, a pendant, a trinket, a hook, a key, a key holder, and a button. The ornamental member 120 may be selectively attached to the ribbon 102, and is generally interchangeable. The ornamental member 120 comprises an outer portion and a cavity 156. The outer portion forms the most visible, prominent ornament in the assembly 100, i.e., the diamond, rhinestone, etc. As shown in 5A, a decorative cap and a single ornamental member or multiple decorative caps 110, as shown in FIG. 5B provide an accent panel.

The ornamental member 120 fastens, attaches, and detaches on to a plurality of caps on the ribbon 102 to enable interchangeability. The cavity 156 forms a mechanical snap closure having a threaded inner surface. The cavity 156 may include a threaded inner surface that is generally circular in shape and has a groove that is configured to mate with a lip. This groove to lip interconnection forms the engagement for the snap fastening mechanism. However, in some embodiments, the cavity 156 is smooth and tapered to create a frictional mating mechanism.

However, in other embodiments, any number of snap fastening mechanisms may be used, including interlocking discs, rivets, and pressure fittings. The groove interconnects with a lip from the cap 110 to create the snap fastening mechanism. The threads on the threaded inner surface also rotatably engage the threaded protrusion 112 from the cap 110. Thus, the cavity 156 fastens with both a snap frictional engagement and a rotational engagement.

For fastening, the ornamental member 120 is configured to couple to the cap 110, such that the cavity 156 of the ornamental member 120 can slip over the cap 110 and twist onto the mounting member 114. After the ornamental member 120 passes over the cap 110, the cavity of the ornamental member 120 rotatably engages the threaded protrusion 112 of the cap 110 in a first direction. This rotation further fastens the ornamental member 120 to the cap 110.

Figure 5D:
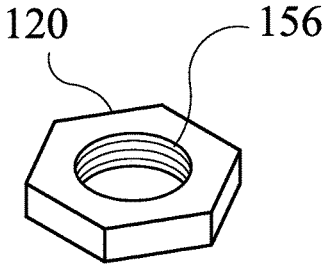
FIG. 5D is a perspective view of an ornamental member with a cavity large enough to allow for it to slip over a cap of the same geometric shape, such as a circle, rectangle, octagon, oval and others and then secure on to a thread protrusion by twisting, in accordance with an embodiment of the present invention.
Figure 6:
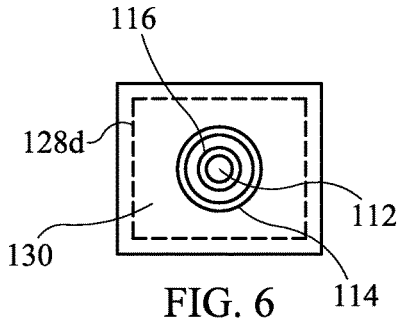
FIG. 6 is a bottom section of an exemplary accent panel mounting surface.
Figure 7A:
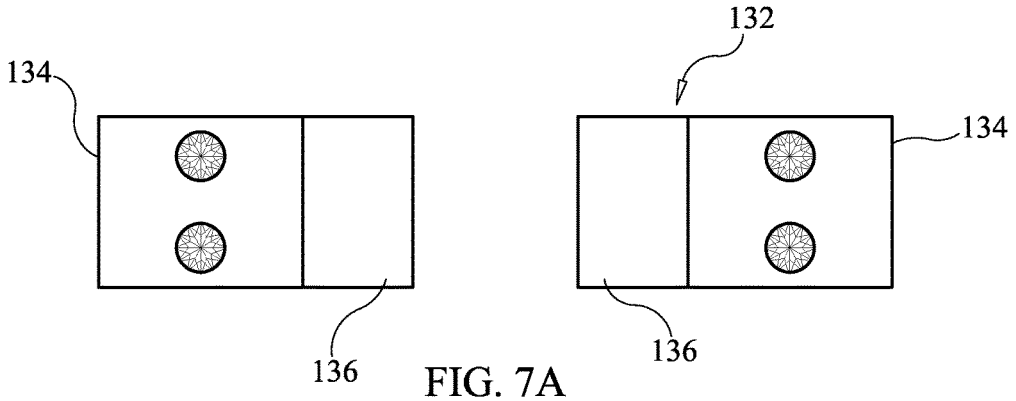
FIG. 7A is a top view of an exemplary connector, with decorative caps in accordance with an embodiment of the present invention.
Figure 7B:
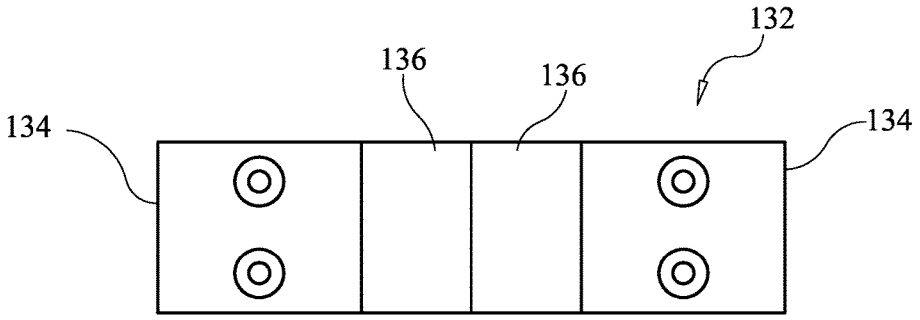
FIG. 7B is the bottom view of two exemplary connectors attached with mounting members.
Figure 7C:
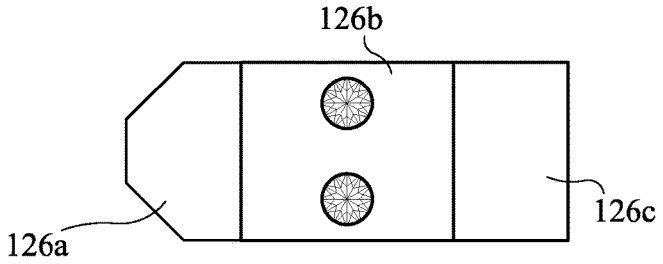
FIG. 7C is a top view of an exemplary connector bracket with a bracket for attaching interchangeable straps and ties with hooks, and 7D shows a different use combination for a bracket connector assembly; connector 7C is attached to connector 7A for the purpose of adding interchangeable straps or ties connected to the bracket by a hook on the strap while also serving as the first end of a ribbon, in accordance with an embodiment of the present invention.
Figure 7D:
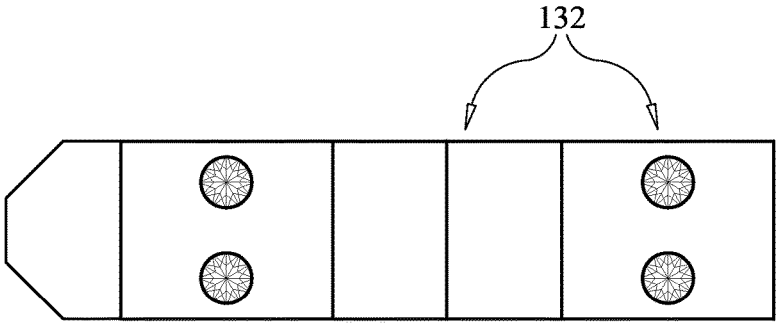

Thus in one possible embodiment shown in FIG. 5A, the ornamental member FIG. 5D is at least partially fastened to the ribbon 102 through rotation in a first direction between the threads of the cavity 156, and the threads of the threaded protrusion 112. Furthermore, a snap lock interaction provides a secondary fastening mechanism. Specifically, the ornamental member 120 is also partially fastened to the ribbon 102 through the interlocking, frictional engagement between the groove of the cavity and the lip on the mechanical closure of the cap 110.

For detachment, the ornamental member 120 is rotated in a second direction and a small pulling force is applied to disengage the threaded cavity 156 of the ornamental member 120 from the threaded protrusion 112 of the cap 110. In this manner, any number and type of ornamental members 120 may be used on the ribbon 102. It is significant to note that not every cap 110 must have an ornamental member 120. The cap 110 is generally decorative and colorful by itself. The ornamental member 120 may also be used solely as an accent.

In one embodiment, a signature stitching is combined with the threaded protrusion on the swimsuit 150 to look appealing even without a ribbon 102. The bottom reception end 116 would have a flat oval surface made out of the same finish as the mounting member such as gold or silver to create a finished look, whether the ribbon 102 is present on the swimsuit 150 or not.

One objective of the assembly 100 is to provide a ribbon 102 that is versatile and can be lengthened with a connector 132 to convert the ribbons 102 into a bracelet or necklace. It may also be desirable to extend the length of the ribbons 102 to compensate for weight gain by a person, whereby the person's swimsuit 150 stretches the ribbons 102. Thus, the assembly 100 may further include a connector 132 that joins adjacent ends of the ribbon 102 to extend the length of the ribbon 102. In this manner, multiple ribbons 102 may be connected at their ends, and thus extended in length to convert ribbons into bracelets, necklaces, or other ornamental articles of jewelry Turning now to FIG. 7, a connector 132 is defined by a first end and a connector second end 136. The first end of connector 134 is configured to detachably join with the ribbon first end 104. The connector second end 136 is configured to join with an adjacent connector second end 136. The first end of connector 134 may include at least two of the ornamental caps 110 that fasten to the connector 134 with two mount ends 119. This not only enhances the decorative aspect of the ribbon 102, but also attaches the ribbon connector 132 thereto.

The connector second end 136 may join with an adjacent ribbon connector 132. This extends the length of the ribbon 102. Thus the ribbon connector 132 performs the dual function of extending the length of the ribbons 102 and providing an ornamental member 120 at the junction with the ribbon 102. In one alternative embodiment, two ribbon connecters 132 may join each other.

Figure 8:
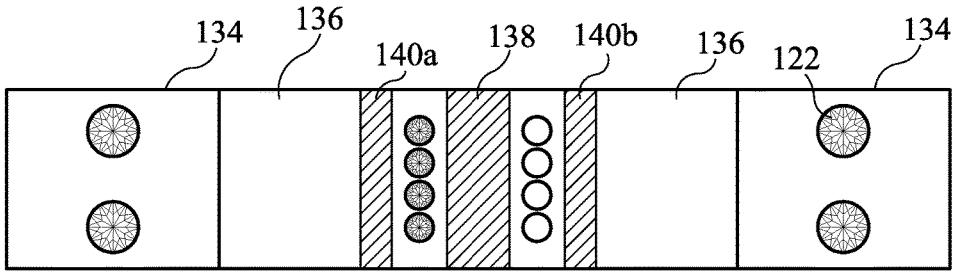
FIG. 8 is a top view of an exemplary expander attached to a pair of connectors, in accordance with an embodiment of the present invention.

As illustrated in FIG. 8, an expander 138 may be used to join two ribbon connectors 132. The expander 138 comprises a pair of free end 140*a*, 140*b* with each free end 140*a*, 140*b* configured to join with a respective second end 136 from the ribbon connector 132. In some embodiments, the expander 138 may have a resilient composition for enabling stretching of the connected ribbons 102. This may be useful for adorning the bracelet around the wrist. Similar to the ribbon connector 132, the expander 138 also enables the ribbons 102 to be extended to form bracelets and necklaces.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims.

What I claim is:

1. An ornamental swimsuit assembly, the assembly comprising:

a swimsuit, the swimsuit defined by a body portion, at least one seam, and at least one strap, the strap configured to detachably attach to the body portion;

a ribbon, the ribbon defined by a ribbon first end, a ribbon second end, a mounting surface, and an ornamental surface, the ribbon configured to overlay the at least one seam of the swimsuit;

a cap, the cap having a threaded protrusion, the threaded protrusion disposed to pass through the ribbon, whereby the cap protrudes from the ornamental surface, and the threaded protrusion protrudes from the mounting surface of the ribbon;

an ornamental member the ornamental member defined by a cavity, the ornamental member configured to detachably join with the cap;

a mounting member, the mounting member comprising a reception end and an mount end, the mount end configured to receive the threaded protrusion of the cap, wherein the ribbon detachably joins the swimsuit through the threaded protrusion of the cap frictionally and rotatably fastening with the mount end of the mounting member;

a connector, the connector defined by a connector first end and a connector second end, the connector first end configured to detachably join with the ribbon first end, the connector second end configured to join with an adjacent connector second end; and an adjustable bracket, the adjustable bracket configured to detachably attach the at least one strap to the body portion of the swimsuit.

2. The assembly of claim 1, wherein the swimsuit includes at least one member selected from the group consisting of: a bikini, a two-piece swimsuit, a one-piece swimsuit, a bathing suit, a thong, a wet suit, and a dry suit.

3. The assembly of claim 1, wherein the ribbon is fabricated from a stretchable, waterproof material.

4. The assembly of claim 1, wherein the cap is colored.

5. The assembly of claim 1, wherein the cap and the cavity form a snap fastening mechanism.

6. The assembly of claim 1, wherein the cap comprises a plurality of caps disposed in a spaced-apart relationship along the length of the ribbon.

7. The assembly of claim 1, wherein the cap has a lip configured to frictionally engage a groove in the cavity.

8. The assembly of claim 1, wherein the threaded protrusion of the cap comprises screw threads that are angled so as to rotate against the cavity of the ornamental member in a first direction for attachment, and a second direction for detachment.

9. The assembly of claim 1, wherein the cap has multiple sizes, the multiple sizes labeled as 5 karat, 7 karat, 8 karat, and 10 karat.

10. The assembly of claim 1, further including a signature stitching on the ribbon that is disposed proximally to the cap, the stitching configured to combine with the threaded protrusion.

11. The assembly of claim 1, wherein the ornamental member includes at least one member selected from the group consisting of: a diamond, a bead, a rhinestone, a gem, a bow, a bell, lace, a band, a strap, a bauble, a pendant, a trinket, a hook, a key, a key holder, and a button.

12. The assembly of claim 1, wherein the ornamental member is fabricated from at least one member selected from the group consisting of: plastic, gold, silver, shell, ivory, wood, glass, and feathers.

13. The assembly of claim 1, wherein the connector bracket comprises a bracket configured to detach the at least one strap form the body of the swimsuit.

14. The assembly of claim 1, wherein the connector bracket is generally U-shaped.

15. The assembly of claim 1, further including an expander, the expander defined by a pair of free ends, each free end configured to join with the second end of the connector.

16. An ornamental swimsuit assembly, the assembly comprising:

a swimsuit, the swimsuit defined by a body portion, at least one seam, and at least one strap, the strap configured to detachably attach to the body portion;

a ribbon, the ribbon defined by a ribbon first end, a ribbon second end, a mounting surface, and an ornamental surface, the ribbon configured to overlay the at least one seam of the swimsuit;

a cap, the cap having a threaded protrusion, the threaded protrusion disposed to pass through the ribbon, whereby the cap protrudes from the ornamental surface, and the threaded protrusion protrudes from the mounting surface of the ribbon;

an ornamental member the ornamental member defined by a cavity, the ornamental member configured to detachably join with the cap;

a mounting member, the mounting member comprising a reception end and an mount end, the mount end configured to receive the threaded protrusion of the cap, wherein the ribbon detachably joins the swimsuit through the threaded protrusion of the cap frictionally and rotatably fastening with the mount end of the mounting member;

a connector, the connector defined by a connector first end and a connector second end, the connector first end configured to detachably join with the ribbon first end, the connector second end configured to join with an adjacent connector second end;

a bracket, the bracket defined by a generally U-shape and a release button, the connector bracket configured to detachably attach the at least one strap to the body portion of the swimsuit, wherein the hook on the at least one strap connects to the U-shaped bracket securing the at least one strap to the body of the swimsuit; and an expander, the expander defined by a pair of free ends, each free end configured to join with the second end of the connector, the expander configured to enable expansion of the length of the ribbon.

17. The assembly of claim 16, wherein the swimsuit includes at least one member selected from the group consisting of: a bikini, a two-piece swimsuit, a one-piece swimsuit, a bathing suit, a thong, a wet suit, and a dry suit.

18. The assembly of claim 16, wherein the ribbon is fabricated from a stretchable, waterproof material.

19. The assembly of claim 16, wherein the cap has a lip configured to frictionally engage a groove in the cavity.

20. The assembly of claim 16, wherein the threaded protrusion of the cap comprises screw threads that rotate against the cavity of the ornamental member in a first direction for attachment, and a second direction for detachment.

* * * * *